US011600439B2

(12) United States Patent
Waeckerle et al.

(10) Patent No.: US 11,600,439 B2
(45) Date of Patent: Mar. 7, 2023

(54) PROCESS FOR MANUFACTURING A THIN STRIP MADE OF SOFT MAGNETIC ALLOY AND STRIP OBTAINED

(71) Applicant: APERAM, Luxembourg (LU)

(72) Inventors: Thierry Waeckerle, Nevers (FR); Rémy Batonnet, Decise (FR)

(73) Assignee: APERAM, Luxembourg (LU)

( * ) Notice: Subject to any disclaimer, the term of this patent is extended or adjusted under 35 U.S.C. 154(b) by 0 days.

(21) Appl. No.: 16/890,954

(22) Filed: Jun. 2, 2020

(65) Prior Publication Data

US 2020/0294715 A1 Sep. 17, 2020

Related U.S. Application Data

(60) Division of application No. 14/365,035, filed as application No. PCT/EP2012/075851 on Dec. 17, 2012, now Pat. No. 10,957,481, which is a continuation of application No. PCT/FR2011/053037, filed on Dec. 16, 2011.

(51) Int. Cl.

| | |
|---|---|
| ***H01F 41/02*** | (2006.01) |
| ***C22F 1/16*** | (2006.01) |
| ***C21D 8/12*** | (2006.01) |
| ***C22C 30/00*** | (2006.01) |
| ***C22C 19/07*** | (2006.01) |
| ***C22F 1/10*** | (2006.01) |
| ***C21D 6/00*** | (2006.01) |
| ***C22C 38/12*** | (2006.01) |
| ***C22C 38/10*** | (2006.01) |
| ***C22C 38/00*** | (2006.01) |
| ***C22C 38/42*** | (2006.01) |
| ***C22C 38/48*** | (2006.01) |
| ***C22C 38/46*** | (2006.01) |
| ***C22C 38/16*** | (2006.01) |
| ***C22C 38/04*** | (2006.01) |
| ***C22C 38/02*** | (2006.01) |
| ***C22C 38/52*** | (2006.01) |
| ***H01F 1/16*** | (2006.01) |
| ***A63B 23/14*** | (2006.01) |
| ***A63B 21/00*** | (2006.01) |
| ***H01F 1/147*** | (2006.01) |

(52) U.S. Cl.

CPC ..... *H01F 41/02* (2013.01); *A63B 21/4017* (2015.10); *A63B 23/14* (2013.01); *C21D 6/007* (2013.01); *C21D 8/12* (2013.01); *C21D 8/1233* (2013.01); *C21D 8/1261* (2013.01); *C22C 19/07* (2013.01); *C22C 30/00* (2013.01); *C22C 38/004* (2013.01); *C22C 38/02* (2013.01); *C22C 38/04* (2013.01); *C22C 38/10* (2013.01); *C22C 38/105* (2013.01); *C22C 38/12* (2013.01); *C22C 38/16* (2013.01); *C22C 38/42* (2013.01); *C22C 38/46* (2013.01); *C22C 38/48* (2013.01); *C22C 38/52* (2013.01); *C22F 1/10* (2013.01); *C22F 1/16* (2013.01); *H01F 1/147* (2013.01); *H01F 1/16* (2013.01); *A63B 2208/12* (2013.01); *Y10T 29/49009* (2015.01); *Y10T 29/49826* (2015.01)

(58) Field of Classification Search

CPC ..... H01F 1/147; C21D 6/007; C22C 19/07
See application file for complete search history.

(56) References Cited

U.S. PATENT DOCUMENTS

| | | | |
|---|---|---|---|
| 3,597,286 | A | 8/1971 | Thornburg |
| 3,622,409 | A | 11/1971 | McCunn |
| 3,634,072 | A | 1/1972 | Ackermann et al. |
| 3,695,944 | A | 10/1972 | Stroble |
| 3,793,092 | A | 2/1974 | Fieldler |
| 4,116,727 | A | 9/1978 | Major |
| 5,501,747 | A | 3/1996 | Masteller et al. |

(Continued)

FOREIGN PATENT DOCUMENTS

| | | | |
|---|---|---|---|
| CN | 1227271 | A | 9/1999 |
| CN | 1400327 | A | 3/2003 |

(Continued)

OTHER PUBLICATIONS

Office Action for U.S. Appl. No. 14/365,035, dated Oct. 12, 2016 in 17 pages.

(Continued)

*Primary Examiner* — Christopher S Kessler
(74) *Attorney, Agent, or Firm* — Knobbe, Martens, Olson & Bear, LLP

(57) ABSTRACT

Method for manufacturing a thin strip in a soft magnetic alloy and strip obtained A method for manufacturing a strip in a soft magnetic alloy capable of being cut out mechanically, the chemical composition of which comprises by weight:

$18\% \leq Co \leq 55\%$
$0\% \leq V + W \leq 3\%$
$0\% \leq Cr \leq 3\%$
$0\% \leq Si \leq 3\%$
$0\% \leq Nb \leq 0.5\%$
$0\% \leq B \leq 0.05\%$
$0\% \leq C \leq 0.1\%$
$0\% \leq Zr + Ta \leq 0.5\%$
$0\% \leq Ni \leq 5\%$
$0\% \leq Mn \leq 2\%$ The remainder being iron and impurities resulting from the elaboration, according to which a strip obtained by hot rolling is cold-rolled in order to obtain a cold-rolled strip with a thickness of less than 0.6 mm.

After cold rolling, a continuous annealing treatment is carried out by passing into a continuous oven, at a temperature comprised between the order/disorder transition temperature of the alloy and the onset temperature of ferritic/austenitic transformation of the alloy, followed by rapid cooling down to a temperature below 200° C. Strip obtained.

5 Claims, No Drawings

(56) References Cited

U.S. PATENT DOCUMENTS

| | | | |
|---|---|---|---|
| 6,146,474 | A | 11/2000 | Coutu et al. |
| 6,153,020 | A | 11/2000 | Chen et al. |
| 2004/0089377 | A1 | 5/2004 | Deevi et al. |
| 2005/0268994 | A1 | 12/2005 | Gerster et al. |

FOREIGN PATENT DOCUMENTS

| | | | |
|---|---|---|---|
| CN | 101636515 | A | 1/2010 |
| EP | 0935008 | A1 | 8/1999 |
| JP | 46-043702 | B | 12/1971 |
| JP | S52-078617 | A | 7/1977 |
| JP | S63-086813 | A | 4/1988 |
| JP | H01-255645 | A | 10/1989 |
| JP | H03-130322 | A | 6/1991 |
| JP | 2009-114511 | A | 5/2009 |
| JP | 2011-174103 | A | 9/2011 |
| SU | 850700 | A1 | 7/1981 |

OTHER PUBLICATIONS

Office Action for U.S. Appl. No. 14/365,035, dated Mar. 15, 2018 in 9 pages.

Final Office Action for U.S. Appl. No. 14/365,035, dated Aug. 24, 2017 in 10 pages.

Final Office Action for U.S. Appl. No. 14/365,035, dated Jan. 24, 2019 in 12 pages.

Notice of allowance for U.S. Appl. No. 14/365,035, dated Mar. 9, 2020 in 12 pages.

Pfeifer, Herbert et al. Practical Handbook Thermal Process Engineering—vol. 1: Basics—Processes—Methods, 2nd Edition, 2011, English translation included (9 pages total).

Imose, Masayuki, "Heating and Cooling Technology in the Continuous Annealing." Trasactions ISIJ, vol. 25, 1985, pp. 911-932.

Bozorth, Richard M., "Ferromagnetism", IEEE Magnestics Society Liaison to IEEE Press, 2003, Chapter 2 "Factors Affecting Magnetic Quality." p. 15 (3 pages total).

PROCESS FOR MANUFACTURING A THIN STRIP MADE OF SOFT MAGNETIC ALLOY AND STRIP OBTAINED

CROSS-REFERENCE TO RELATED APPLICATIONS

This application is a divisional of U.S. application Ser. No. 14/365,035, filed on Jun. 12, 2014 as the U.S. National Phase under 35. U.S.C. § 371 of International Application PCT/EP2012/075851, filed Dec. 17, 2012, now granted, which is a continuation of PCT/FR2011/053037, filed on Dec. 16, 2011. The disclosures of the above described applications are hereby incorporated by reference in their entirety.

STATEMENT REGARDING FEDERALLY SPONSERED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

FIELD OF THE INVENTION

The present invention relates to the manufacturing of a strip in soft magnetic alloy of the iron-cobalt type.

DESCRIPTION OF RELATED ART INCLUDING INFORMATION DISCLOSED UNDER 37 CFR 1.97 AND 1.98

Not Applicable

BACKGROUND OF THE INVENTION

Many pieces of electro-technical equipment include magnetic parts and notably magnetic yokes made in soft magnetic alloys. In particular, this is the case of electric generators on board vehicles notably in the field of aeronautics, railways or automobiles. Generally, the alloys used are alloys of the iron-cobalt type and notably alloys including about 50% by weight of cobalt. These alloys have the advantage of having very strong induction at saturation, high permeability at working inductions greater than or equal to 1.6 Teslas and quite strong resistivity allowing reduction of alternating current losses at a high induction. When they are in current use, these alloys have a mechanical strength corresponding to an elasticity limit comprised between about 300 and 500 MPa. However, for certain applications, it is desirable to have alloys with a high elastic limit, the elasticity limit of which may attain or exceed 600 MPa, or even in certain cases 900 MPa. The latter so-called HEL alloys are particularly useful for producing miniaturized alternators on board aircraft. These alternators are characterised by very high speeds of rotation which may exceed 20,000 rpm which require great mechanical strength of the parts making up the magnetic yokes. In order to obtain the characteristics of alloys with a high elasticity limit, the addition of different alloy elements such as niobium, carbon and boron notably was proposed in various patents.

All these materials containing from 15 to 55% by weight of cobalt, regardless of whether they have an approximately equiatomic Fe—Co composition or whether they contain much more iron than cobalt, have to be subject to suitable annealing in order to obtain desired properties of use, and notably good compromise between the sought mechanical characteristics and magnetic characteristics depending on the uses for which they are intended. For these alloys, it is known, well established and practiced that the electro-technical parts (stators, rotor and other various profiles) are cut out in strips of work-hardened material obtained by cold rolling down to the final thickness. After having been cut out, the parts are systematically subject in a last step, to annealing of the static type in order to adjust the magnetic properties.

By state-of-the-art static annealing of Fe—Co alloys, is meant a heat treatment during which the cut out parts are maintained above 200° C. for at least 1 hour and they are raised to a temperature greater than or equal to 700° C., at which a plateau is imposed. By plateau is meant a period of time of at least 10 minutes during which the temperature at most varies by 20° C. above or below a set temperature value. In this treatment, the rises and drops between room temperature and the plateau generally take a time of at least 1 hour under industrial production conditions. Consequently, an industrial «static» annealing treatment allowing good optimization of magnetic performances, comprises for this a temperature plateau from one to several hours: «static» annealing therefore takes several hours.

In a way known per se to one skilled in the art, cold rolling is carried out on strips with a thickness generally of the order of 2 to 2.5 mm, obtained by hot rolling and then subject to hyper-quenching. The latter gives the possibility of avoiding to a large extent the order/disorder transformation in the material which consequently remains almost disordered, but not very changed relatively to its structural state at a temperature above 700° C. Because of this treatment, the material may then be cold rolled without any problem down to the final thickness.

The thereby obtained strips then have sufficient ductility so as to be able to be cut out by mechanical cutting. Also, when they are intended for the manufacturing of magnetic yokes consisting of a stack of cut out parts in thin strips, these alloys are sold to the users in the form of strips in a work-hardened state. The user then cuts out the parts, stacks them and ensures the mounting or the assembling of magnetic yokes, and then carries out the required quality heat treatment for obtaining the sought properties. This quality heat treatment aims at obtaining a certain development of the growth of the grains after recrystallization, since it is the grain size which sets the compromise between mechanical and magnetic performances. Depending on the relevant parts of the electro-technical machine, the compromises as regards performances, and therefore the heat treatments, may be different. Thus, generally, the stators and rotors of aeronautical on board generators are cut out together in the same strip portion in order to minimize the scraps of metal.

But, the rotor undergoes a heat treatment promoting quite high mechanical performances, typically a temperature of less than 800° C., while the stator undergoes a heat treatment optimizing the magnetic performances (therefore with a larger average grain size) typically at a temperature above 800° C.

Further, this quality heat treatment may include for each type of cut out part, two annealings, one for adjusting the magnetic and mechanical properties as this has just been seen and the other one for oxidizing the surfaces of the metal sheets in order to reduce the inter-laminar magnetic losses. This second annealing may also be replaced with deposition of an organic, mineral or mixed material.

The drawbacks of this technique according to this prior art are multiple and mention will in particular be made of:

- the requirement of changing alloy (complicated, larger inventory, more costly) when it is desired to attain elastic limits of at least 500-600 MPa; indeed the Fe—Co alloy known to one skilled in the art suitable for most electro-technical applications, may attain soft magnetic properties such as a coercitive field from 0.4 to 0.6 Oe (32 to 48 A/m) when the annealing is at least carried out at 850° C. and may also attain an elastic limit of 450-500 MPa when the annealing temperature is lowered to below 750° C.; in every case, the elastic limit never attains 600 MPa on the same alloy; in order to manage this, other alloys, slightly different in composition, notably using precipitates or a $2^{nd}$ phase, have to be used;
- the requirement for the user to anneal all the cut out parts (whether the grade is with a high elastic limit (HEL) or not); indeed, after static annealing, the alloy is too fragile in order to be able to be cut out with mechanical means;
- the requirement of having to support high magnetic losses for elastic limits of at least 500 MPa;
- the difficulty or even the impossibility for HEL performances of attaining with the heat treatment, a specific compromise in mechanical and magnetic performances; indeed, theoretically, it is always possible to obtain HEL performances (from 500 to 1200 MPa of elasticity limit) with a «static annealing», as defined above by applying temperature plateaus between 700 and 720° C., therefore in a metallurgical state ranging from the work-hardened state and then restored to a more or less crystallized state and specific to this type of annealing; but in practice, in this range of 500-1200 MPa, the elastic limit will very substantially depend on the plateau temperature to within a degree; this hypersensitivity of the performances at the plateau temperature prevents industrial transposition since static industrial ovens cannot generally ensure temperature homogeneity of the load to be annealed of better than +/−10° C., i.e. the extent of the adjustment range of the elastic limit between 500 and 1200 MPa; exceptionally, this homogeneity may be of +/−5° C.; however, this is not sufficient for controlling industrial manufacturing.
- the difficulty in attaining specific dimensions of a finished part when the final static annealing is applied to parts cut out in a work-hardened metal, with a complex geometry (example, a E-part/profile of a transformer with elongated legs).

SUMMARY OF THE INVENTION

The object of the present invention is to find a remedy to these drawbacks by proposing a method with which a thin strip in a soft magnetic alloy of the iron-cobalt type may be manufactured, which, from the same alloy, gives the possibility of proposing a strip which may easily be cut out which may also have, in a pre-defined way, both an average and very high elasticity limit while retaining the possibility of obtaining good to very good magnetic properties by subsequently applying a second static or continuous heat treatment, the alloy being capable of passing from a state with a high elasticity limit to a state with high magnetic performance under the effect of annealing such as for example conventional static annealing, the alloy further having good resistance to aging of its mechanical properties up to 200° C.

For this purpose, the object of the invention is a method for manufacturing a strip in a soft magnetic alloy capable of being mechanically cut out, the chemical composition of which comprises by weight:

| |
|---|
| 18% ≤ Co ≤ 55% |
| 0% ≤ V + W ≤ 3% |
| 0% ≤ Cr ≤ 3% |
| 0% ≤ Si ≤ 3% |
| 0% ≤ Nb ≤ 0.5% |
| 0% ≤ B ≤ 0.05% |
| 0% ≤ C ≤ 0.1% |
| 0% ≤ Zr + Ta ≤ 0.5% |
| 0% ≤ Ni ≤ 5% |
| 0% ≤ Mn ≤ 2% |

The remainder consisting of iron and impurities resulting from elaboration,

According to this method, a strip obtained by hot rolling of a semi-finished product consisting of this alloy, is cold rolled in order to obtain a cold rolled strip with a thickness of less than typically 0.6 mm and after cold rolling, an continuous annealing treatment is carried out on the strip by having it pass into a continuous oven, at a temperature comprised between the order/disorder transition temperature of the alloy (for example 700-710° C. for the Fe-49% Co-2% V alloy well known to one skilled in the art) and the ferritic/austenitic transformation point of the alloy (typically 880-950° C. for the Fe—Co alloys of the invention), followed by rapid cooling down to a temperature of less than 200° C.

The annealing temperature is preferably comprised between 700° C. and 930° C.

Preferably, the running speed of the strip is adapted so that the dwelling time of the strip at the annealing temperature is less than 10 mins.

Preferably, the cooling rate of the strip upon exiting the treatment oven is greater than 1000° C./h.

According to the invention, the running speed of the strip in the oven is adapted as well as the annealing temperature for adjusting the mechanical strength of the strip.

Preferably, the chemical composition of the alloy is such that:

| |
|---|
| 47% ≤ Co ≤ 49.5% |
| 0.5% ≤ V ≤ 2.5% |
| 0% ≤ Ta ≤ 0.5% |
| 0% ≤ Nb ≤ 0.5% |
| 0% ≤ Cr ≤ 0.1% |
| 0% ≤ Si ≤ 0.1% |
| 0% ≤ Ni ≤ 0.1% |
| 0% ≤ Mn ≤ 0.1% |

This method has the advantage of giving the possibility of manufacturing a thin strip which may easily be cut with mechanical means and which differs from the known strips by its metallurgical structure. In particular, the strip obtained by this method is a strip in cold rolled soft magnetic alloy with a thickness of less than 0.6 mm, consisting of an alloy for which the chemical composition comprises by weight:

| |
|---|
| 18% ≤ Co ≤ 55% |
| 0% ≤ V + W ≤ 3% |
| 0% ≤ Cr ≤ 3% |
| 0% ≤ Si ≤ 3% |
| 0% ≤ Nb ≤ 0.5% |
| 0% ≤ B ≤ 0.05% |
| 0% ≤ C ≤ 0.1% |
| 0% ≤ Zr + Ta ≤ 0.5% |
| 0% ≤ Ni ≤ 5% |
| 0% ≤ Mn ≤ 2% |

the remainder consisting of iron and impurities resulting from the elaboration, the metallurgical structure of which is:

either of the «partly crystallized», type, i.e. on at least 10% of the surface of samples observed under the microscope with a magnification of ×40 after chemical etching with iron perchloride, it is not possible to identify grain boundaries;

or of the «crystallized» type, i.e. on at least 90% of the surface of samples observed under the microscope with ×40 magnification after chemical etching with iron perchloride, it is possible to identify a network of grain boundaries and in the range of grain sizes from 0 to 60 $\mu m^2$, there exists at least one class with a grain size width of 10 $\mu m^2$ comprising at least twice more grains than the same class of grain sizes corresponding to the observation of a comparable cold rolled strip having the same composition, not having been subject to continuous annealing but having been subject to static annealing at a temperature such that the difference between the coercitive field obtained with static annealing and the coercitive field obtained with continuous annealing is less than half of the value of the coercitive field obtained by the continuous treatment and in the range of grain sizes from 0 to 60 $\mu m^2$, there exists at least one class size of grains of 10 $\mu m^2$ of width, for which the ratio of the number of grains to the total number of grains observed on the sample having undergone continuous annealing is greater by at least 50% than the same ratio corresponding to a sample taken on the comparable cold rolled strip having undergone static annealing.

As it is obvious for one skilled in the art, the term of «crystallized» is used here as a synonym of «recrystallized». Indeed, the cold rolled strip in the form of a thin strip is totally work-hardened, i.e. the crystalline order is totally dislocated at a long distance, and the notion of crystals or «grain», no longer exists. The continuous annealing treatment then allows «crystallization, of this work-hardened matrix in crystals or grains. This phenomenon is nevertheless also called recrystallization since this is not the first crystallization experienced by the alloy since its elaboration phase from the solidified liquid metal.

Preferably, the chemical composition of the soft magnetic alloy is such that:

| |
|---|
| 47% ≤ Co ≤ 49.5% |
| 0.5% ≤ V ≤ 2.5% |
| 0% ≤ Ta ≤ 0.5% |
| 0% ≤ Nb ≤ 0.5% |

-continued

| |
|---|
| 0% ≤ Cr ≤ 0.1% |
| 0% ≤ Si ≤ 0.1% |
| 0% ≤ Ni ≤ 0.1% |
| 0% ≤ Mn ≤ 0.1% |

and the elasticity limit $R_{P0.2}$ is comprised between 590 MPa and 1,100 MPa, the coercitive field He is comprised between 120 A/m and 900 A/m, the magnetic induction B for a field of 1,600 A/m is comprised between 1.5 and 1.9 Teslas.

Further, the magnetization upon saturation of the strip is greater than 2.25 T.

With this strip, it is possible to manufacture parts for magnetic components, for example rotor and stator parts and notably for a magnetic yoke, and magnetic components such as magnetic yokes, by directly cutting out the parts in a strip according to the invention and then, if necessary, by assembling the thereby cut-out parts so as to form components such as yokes, and by optionally having some of them (for example only stator parts) or some of them (for example stator yokes) undergo a complementary annealing treatment allowing optimization of the magnetic properties, and in particular minimization of the magnetic losses.

Also, the object of the invention is also a method for manufacturing a magnetic component according to which a plurality of parts are cut out by mechanical cutting from a strip obtained by the previous method, and after cut-out, the parts are assembled for forming a magnetic component.

Further, it is possible to subject the magnetic component or the parts to quality static annealing i.e. an annealing for optimizing the magnetic properties.

Preferably, the quality static annealing or for optimizing the magnetic properties is annealing at a temperature comprised between 820° C. and 880° C. for a time comprised between 1 hour and 5 hours.

The magnetic component is for example a magnetic yoke.

The invention will now be described more specifically but in a non-limiting way and illustrated by examples.

In order to manufacture cold rolled thin strips intended for manufacturing by mechanical cutting out of magnetic yoke parts of electro-technical equipment, an alloy known per se is used, for which the chemical composition comprises by weight: from 18% to 55% of cobalt, from 0% to 3% of vanadium and/or of tungsten, from 0% to 3% of chromium, from 0% to 3% of silicone, from 0% to 0.5% of niobium, from 0% to 0.05% of boron, from 0% to 0.1% of C, from 0% to 0.5% of zirconium and/or of tantalum, from 0% to 5% of nickel, from 0% to 2% of manganese, the remainder being iron and impurities resulting from the elaboration.

Preferably, the alloy contains from 47% to 49.5% of cobalt, from 0% to 3% of the vanadium+tungsten sum, from 0% to 0.5% of tantalum, from 0% to 0.5% of niobium, less than 0.1% of chromium, less than 0.1% of silicon, less than 0.1% of nickel, less than 0.1% of manganese.

Further, the vanadium content should preferably be greater than or equal to 0.5% in order to improve the magnetic properties and to better escape from the embrittlement ordering during rapid cooling, and remain less than or equal to 2.5% in order to avoid the presence of the second non-magnetic austenitic second phase, the tungsten not being indispensable, and the niobium contents should preferably be greater than or equal to 0.01% in order to control grain growth at a high temperature and in order to facilitate hot transformation. Niobium is actually a growth inhibitor giving the possibility of limiting germination of the crystallization and the grain growth together upon continuous annealing.

The alloy contains a little carbon so that, during elaboration, de-oxidation is sufficient, but the carbon content should remain less than 0.1% and preferably less than 0.02% or even 0.01% in order to avoid formation of too many carbides which deteriorate the magnetic properties.

There is no lower limit defined for the contents of elements such as Mn, Si, Ni or Cr. These elements may be absent, but they are in general present at least in a very small amount subsequent to their presence in the raw materials or subsequent to pollution by refractory materials of the elaboration oven. These elements have no influence on the magnetic properties of the alloy when they are present in very small amounts. When their presence is significant, this means that they have been added voluntarily, in order to adjust the magnetic properties of the alloy to the targeted application.

This alloy is for example the alloy known under the name of AFK 502R which essentially contains about 49% of cobalt, 2% of vanadium and 0.04% de niobium, the remainder consisting of iron and impurities as well as small amounts of the elements such as C, Mn, Si, Ni and Cr.

This alloy is elaborated in a way known per se and cast in the form of semi-finished products such as ingots. In order to manufacture a thin strip, a semi-finished product such as an ingot is hot rolled in order to obtain a hot strip, the thickness of which depends on the practical manufacturing conditions. As an indication, this thickness is generally comprised between 2 and 2.5 mm. At the end of the hot rolling, the obtained strip is subject to hyper-quenching. This treatment gives the possibility of avoiding to a very large extent the order/disorder transformation in the material so that the latter remains in an almost disordered structural state, not very changed relatively to its structural state at a temperature above 700° C. and which, consequently is sufficiently ductile so as to be able to be cold rolled. Hyper-quenching therefore allows the hot strip to then be cold rolled without any problem down to the final thickness. Hyper-quenching may be directly achieved upon exiting hot rolling if the temperature at the end of rolling is sufficiently high, or, in the opposite case, after heating up to a temperature above the order/disorder transformation temperature. In practice, in the embrittlement ordering which is established between 720° C. and room temperature, either the metal is suddenly cooled with water for example (typically at a rate above 1,000° C./min), upon exiting hot rolling from a temperature of 800-1,000° C. down to room temperature, or the hot rolled metal subsequently cooled down slowly, therefore brittle, is heated up to between 800 and 1,000° C. before sudden cooling down to room temperature. Such a treatment is known per se to one skilled in the art who knows how to achieve it on the apparatuses which are customarily available to him/her.

After hyper-quenching, the hot strip is cold rolled in order to obtain a cold strip having a thickness of less than 1 mm, preferably less than 0.6 mm, generally comprised between 0.5 mm and 0.2 mm and which may be lowered down to 0.05 mm.

After having manufactured the work-hardened cold rolled strip, it is subject to continuous annealing in a continuous oven, at a temperature such that the alloy is in a disordered ferritic phase. This means that the temperature is comprised between the ordered/disordered transformation temperature and the ferritic/austenitic transformation point. For an iron-cobalt alloy having a cobalt content comprised between 45 and 55% by weight, the annealing temperature should be comprised between 700° C. and 930° C. The temperature range of continuous annealing may be all the more extended towards low temperatures since the cobalt content will approach 18%. For example, with 27% of cobalt, the annealing temperature should be comprised between 500 and 950° C. One skilled in the art knows how to determine this annealing temperature according to the composition of the alloy.

The speed of passing in the oven may be adapted in order to take into account the length of the oven so that the time for passing into the homogenous temperature area of the oven is less than 10 minutes and preferably comprised between 1 and 5 minutes. In any case, the time for maintaining the treatment temperature should be greater than 30 s. For an industrial oven with a length of the order of one meter, the speed should be greater than 0.1 m/mn. For another type of industrial oven of a length of 30 m, the continuous speed should be greater than 2 meters per minute, and preferably from 7-40 m/min. Generally, one skilled in the art knows how to adapt the continuous speeds according to the length of the ovens at his/her disposal.

It should be noted that the treatment oven used may be of any type. In particular, this may be a conventional oven with resistors or else an oven with thermal radiation, an annealing oven with the Joule effect, an installation for annealing with a fluidized bed or any other type of oven.

Upon exiting the oven, the strip should be cooled at a sufficiently rapid rate in order to avoid the occurrence of a total order-disorder transformation. However, the inventors were surprised in noticing that unlike a strip with a thickness of 2 mm which has to be hyper-quenched in order to be then able to be cold rolled, a strip with a small thickness (0.1-0.5 mm) intended to be machined, stamped, punched may only be subject to partial ordering, the result of which is only a low level of embrittlement so that hyper-quenching is not required.

The inventors were also surprised in noticing that at the end of continuous annealing as this has just been described, the possibility of cutting out the strip becomes very good from the moment that the disorder/order transformation is not complete. This unexpectedly means that such a strip may be cut out with mechanical means in spite of partial ordering generating a certain level of embrittlement.

In order that the disorder/order transformation be not complete, the cooling rate—as determined between the order/disorder temperature (700° C. for a conventional alloy with a composition close to Fe-49% Co-2% V) and 200° C.—should be greater than 600° C. per hour, and preferably greater than the 1,000° C. per hour or even than 2,000° C./h. In practice, it is unnecessary to exceed 10,000° C./h and a rate comprised between 2,000° C./h and 3,000° C./h is generally sufficient.

The inventors surprisingly noticed that with such continuous germination of the crystallization treatment, and unlike what is noticed with static heat treatments giving the possibility of obtaining comparable mechanical or magnetic properties, sufficiently ductile strips were obtained so as to be able to be mechanically cut out for manufacturing parts intended to be stacked for forming magnetic yokes or any other magnetic component.

The inventors also noticed that by adjusting the time for passing into the oven, it is possible to adjust the obtained mechanical characteristics on the strip so that, from a standard iron-cobalt alloy, it is possible to obtain both alloys with customary mechanical characteristics, i.e. with an elasticity limit comprised between 300 and 500 MPa, and alloys of the high elasticity limit (HEL) type i.e. having an elasticity limit greater than 500 MPa, preferably comprising between 600 and 1,000 MPa, and which may attain 1,200 MPa. Of course, these heat treatments lead to magnetic properties which are very different, in particular as regards magnetic losses. The standard iron-cobalt alloy is for example an iron-cobalt alloy of the AFK 502R type essentially containing 49% of cobalt, 2% of vanadium and 0.04% of Nb, the remainder being iron and impurities.

The inventors noticed that this set of unusual performances, i.e. capability of being cut out in the annealed state, while desirably setting the elastic limit between 300 and 1,200 MPa, was closely related to the particular metallurgical structure obtained by continuous annealing according to the invention which is different from the metallurgical structure from static annealing. In particular, this relates to the crystallization rate and, for sufficiently crystallized materials, the distribution of the grain sizes, which is very different from the one obtained with static annealings giving the possibility of obtaining the same properties of use of the material.

The effects of the continuous heat treatment and of its occurrence conditions on the mechanical and magnetic properties of an alloy of the 50% Cobalt type, will now be described more specifically from a series of tests.

Laboratory tests were conducted on the one hand on a non-standard composition alloy AFK502NS (casting JB990) which contains 48.6% Co-1.6% V-0.119% Nb-0.058% Ta-0.012% C, the remainder being iron and impurities and on a conventional alloy grade of the AFK 502 R type (casting JD173) i.e. a standard alloy containing 48.6% Co-1.98% V-0.14% Ni-0.04% Nb-0.007% C. The remainder is iron and impurities. These alloys which were first manufactured in the form of cold rolled strips with a thickness of 0.2 mm were subject to heat treatments by having them pass into a hot oven with maintaining a temperature of 785° C., 800° C., 840° C. and 880° C. respectively for one minute. These heat treatments which allow simulation of a heat treatment as an industrial stream, were conducted under argon and were followed by fast cooling at a rate comprised between 2,000° C./h and 10,000° C./h, and a little more specifically 6,000+/−3,000° C./h taking into account the uncertainty of the determination of this type of rate and of the cooling rate non-uniformity between the plateau temperature and 200° C. or room temperature. These tests gave the possibility of obtaining the results transferred to Table 1.

In Table 1:

T: is the annealing temperature in ° C.

B1600: is the magnetic induction expressed in Teslas, for a magnetic field of 1,600 A/m (about 20 Oe).

Br/Bm: is the ratio of the remnant magnetic induction Br to the maximum magnetic induction Bm obtained upon magnetic saturation of the sample.

Hc: is the coercitive field in A/m

Losses: are the magnetic losses in W/kg dissipated by the induced currents when the sample is subject to a variable magnetic field which, in the present case, is an alternating field with a frequency of 400 Hz inducing an alternating sinusoidal induction by the use of electronic servo-control of the applied magnetic field, which is known per se to one skilled in the art, the maximum value of the magnetic field is 2 Teslas.

$R_{P0}0.2$= is the conventional elasticity limit measured in pure traction on standardized samples.

TABLE 1 effects of the continuous heat treatment and of its occurrence conditions on the mechanical and magnetic properties

| Grade | Casting | T (° C.) | B1600 (Tesla) | Br/Bm | Hc (A/m) | Losses (W/kg) | $R_{P0,2}$ (MPa) |
|---|---|---|---|---|---|---|---|
| AFK502R (standard) | JD173 | 785 | 1.5850 | 0.83 | 822 | 339 | 990 |
| | | 800 | 1.6230 | 0.80 | 629 | 272 | 890 |
| | | 840 | 1.7560 | 0.49 | 183 | 106 | 660 |
| | | 880 | 1.7500 | 0.40 | 130 | 85 | 600 |
| AFK502NS (non-standard) | JB990 | 785 | 1.5180 | 0.81 | 883.3 | 381 | 1090 |
| | | 800 | 1.5490 | 0.80 | 779.96 | 336 | 970 |
| | | 840 | 1.7260 | 0.64 | 306.40 | 156 | 760 |
| | | 880 | 1.8080 | 0.45 | 148 | 95.5 | 620 |

After heat treatment, mechanical cutting-out tests were conducted by means of punches and dyes. From these results, it emerges that after continuous annealing, it is possible to cut out parts under satisfactory conditions without any apparent sign of embrittlement both with the non-standard composition grade AFK502NS, and with the standard or conventional grade AFK502R. It is also noticed that by adapting the temperature of continuous annealing between 785° C. and 880° C., it is possible to obtain mechanical properties of the high elasticity limit type, both for the alloy AFK502NS and for the conventional alloy AFK502R and that the mechanical characteristics obtained are very comparable. Consequently, it appears that it is not necessary to use two distinct grades for obtaining alloys of the type with high elasticity limit or alloys with current elasticity limit, i.e. for manufacturing parts in a high elasticity limit alloy or in a common elasticity limit alloy.

Further, these results show that the magnetic properties, including the losses measured under an alternating field with a maximum amplitude of 2 Teslas at a frequency of 400 Hertz, are quite comparable. Moreover, it is noticed that the relationship between magnetic velocities and elasticity limit for metal sheets of a thickness of 0.20 mm, measured on washers cut out in the annealed strip, are quite comparable for these 2 alloys of different composition.

On these materials, in the state posterior to the annealing described above, high temperature annealing, so called «optimization static annealing» was also carried out, intended for optimizing the magnetic characteristics. This annealing was carried out on washers with static annealing at a temperature of 850° for three hours. The results obtained with this optimization static annealing are transferred in Table 2 below.

TABLE 2 magnetic properties after optimization annealing

| Grade | Casting | T (° C.) | B at 1,600 A/m (Tesla) | Br/Bm | Hc (A/m) | Losses (W/kg) 2 T-400 Hz |
|---|---|---|---|---|---|---|
| Standard AFK502R according to the invention | JD173 | 785 | 2.2110 | 0.69 | 51.7 | 36.0 |
| | | 800 | 2.2040 | 0.69 | 50.9 | 35.5 |
| | | 840 | 2.1970 | 0.66 | 50.9 | 35.0 |
| | | 880 | 2.2010 | 0.67 | 53.3 | 34.0 |
| Standard AFK502R without continuous annealing, with standard static annealing at 850° C. | JD173 | 850 | 2.225 | 0.71 | 0.70 | 36 |
| Non-standard AFK502NS According to the invention | JB990 | 785 | 2.2140 | 0.78 | 62.1 | 52.0 |
| | | 800 | 2.2040 | 0.74 | 58.9 | 53.5 |
| | | 840 | 2.2140 | 0.78 | 62.1 | 54.0 |
| | | 880 | 2.2190 | 0.79 | 62.9 | 51.0 |
| Non-standard AFK502R without continuous annealing, with standard static annealing at 850° C. | JB 990 | 850 | 2.244 | 0.79 | 1.1 | 52 |

Considering these results, it may be noticed that the magnetic losses at 400 Hertz under a field of 2 Teslas are considerably reduced and more generally that the whole of the magnetic properties obtained practically do not depend on the continuous annealing temperature. These properties are moreover quasi identical with the properties obtained on washers extracted from strips with a thickness of 0.2 mm which were not annealed continuously, but which were directly subject to the same optimization static annealing, which corresponds to the prior art.

These results show that continuous annealing provides an advantage to the material of the AFK502R (conventional grade) type: indeed with this material it is possible to produce pre-annealed strips having HEL characteristics which further may be cut out and shaped in this pre-annealed state.

Further, it is noticed that the mechanical properties/magnetic properties compromise may be adjusted by the continuous annealing temperature. Consequently, an alloy having the chemical composition of these examples may be used by a customer who wishes to manufacture both parts with high mechanical characteristics and parts with common mechanical characteristics and who will be able to only carry out the optimization static annealing on the parts which he/she has cut out in order to simply optimize the magnetic losses if this is necessary.

Moreover, a series of tests were conducted on strips in an industrial alloy AFK502R of standard composition, work-hardened with a thickness of 0.35 mm. During these tests, continuous annealing treatments were carried out at different velocities for passing into an industrial oven having a useful length of 1.2 m. By useful length, is meant the length of the oven in which the temperature is sufficiently homogenous so that it corresponds to the temperature plateau of annealing.

The chemical compositions of the samples used are transferred to Table 3. In this table, all the elements are not indicated and one skilled in the art will understand that the remainder is iron and impurities resulting from the elaboration, as well as optional elements in a small amount such as carbon.

TABLE 3 chemical compositions of the samples used

| Casting | Mark | Co | V | Nb | Mn | Cr | Si | Ni |
|---|---|---|---|---|---|---|---|---|
| No. 1 | JD842 | 48.61 | 1.99 | 0.041 | 0.027 | 0.015 | 0.016 | 0.04 |
| No. 2 | JE686 | 48.49 | 2.00 | 0.037 | 0.042 | 0.031 | 0.061 | 0.10 |
| No. 3 | JE798 | 48.01 | 1.99 | 0.041 | 0.043 | 0.040 | 0.057 | 0.16 |
| No. 4 | JE799 | 48.51 | 1.96 | 0.040 | 0.035 | 0.028 | 0.051 | 0.06 |
| No. 5 | JE872 | 48.45 | 1.98 | 0.041 | 0.043 | 0.049 | 0.069 | 0.14 |

The passing rates in the oven were selected so that each of these treatments corresponds to a spent time above 500° C., beginning of the restoration temperature, of substantially less than 10 minutes.

The continuous annealings were carried out at three rates: 1.2 m per minute for obtaining the magnetic and mechanical properties corresponding to the use for making stator magnetic yokes for which low to average magnetic loss levels are sought; a rate of 2.4 m per minute for obtaining the mechanical characteristics adapted to the manufacturing of magnetic yokes of rotors, and of 3.6 and 4.8 m per minute for obtaining the mechanical characteristics corresponding to the HEL quality. Further, as a comparison, static annealing at the temperature of 760° C. was carried out on samples for two hours. This annealing is an annealing type of the conventional «optimization static annealing», which leads to properties comparable with those of the continuous annealing at the rate of 1.2 m per minute at 880° C. Finally, for the highest continuous annealing temperature (880° C.), the running rate was further lowered (in the limit of a plateau of 10 mins) in order to further reduce the magnetic losses and the elasticity limit. Indeed, for certain applications, it is possible to request rather low magnetic losses at the stator. These results show that this actually allows reduction of $R_{P0.2}$ below 400 MPa which is interesting as an extended range for adjusting the elasticity limit by simply adjusting the running rate. On the other hand, the magnetic losses are not reduced relatively to the speed of neighboring value. Thus, if the intention is to significantly reduce the magnetic losses, it is necessary to carry out an additional magnetic optimization static annealing as shown by the results of Table 2.

The results of the tests conducted with the casting No. 1, JD842 are transferred to Table 4, the results obtained with the other castings being comparable.

These results show that it is possible to adjust the elasticity limit $R_{P0.2}$ in a very wide range of values between 400 MPa and 1,200 MPa by varying the annealing parameters which are the speed for passing in the oven, i.e. the high temperature dwelling time and the annealing temperature and this under satisfactory conditions for industrial production. Indeed, the obtained properties vary sufficiently slowly with the treatment parameters so that it is possible to control industrial manufacturing. These results also show that there is strong correlation between the elasticity limit, the coercitive field and the various other properties of the alloy.

Moreover, these tests allow the identification of the effects of the heat treatment on the metallographic structure of the alloy manufactured by the method according to the invention. The tests were in particular conducted on the casting JD842. The measurements were made notably on a metal sheet having undergone continuous annealing at 880° C. with various running speeds. The temperature of 880° C. was selected since it is the one which corresponds to the optimum for obtaining good magnetic properties, i.e. at a temperature, at which it is possible to obtain both low values of magnetic losses and a wide range of elasticity limits (for example from 300 MPa to 800 MPa) by simply varying the running speed with values only leaving the alloy for a few minutes (<10 mn) in the temperature plateau zone.

TABLE 4

Mechanical and magnetic properties versus the running speed during the continuous annealing

| Conditions of continuous annealing | | DC current | | | Losses (W/kg) at 400 Hz | | |
|---|---|---|---|---|---|---|---|
| | | B1600 | | Hc | B = 1.5 | B = 2 | $R_{P0.2}$ |
| $T_{RD}$ (° C.) | V (m/min) | (Tesla) | Br/Bm | (A/m) | Tesla | Tesla | (MPa) |
| 760° C. | 1.2 | 1.6750 | 0.69 | 321 | 111 | 205 | 665 |
| | 2.4 | 1.5400 | 0.83 | 907 | 252 | 420 | 1030 |
| | 3.6 | 1.5250 | 0.84 | 939 | 264 | 443 | 1140 |
| | 4.8 | 1.5250 | 0.84 | 907 | 255 | 414 | 1230 |
| 785° C. | 1.2 | 1.7700 | 0.48 | 127 | 65 | 125 | 540 |
| | 2.4 | 1.7050 | 0.75 | 446 | 135 | 245 | 760 |
| | 3.6 | 1.5300 | 0.83 | 915 | 255 | 430 | 1060 |
| | 4.8 | 1.5300 | 0.86 | 915 | 260 | 432 | 1200 |
| 810° C. | 1.2 | 1.7350 | 0.46 | 122 | 66 | 125 | 540 |
| | 2.4 | 1.7750 | 0.53 | 151 | 71 | 137 | 580 |
| | 3.6 | 1.6400 | 0.76 | 549 | 163 | 286 | 830 |
| | 4.8 | 1.5200 | 0.84 | 947 | 266 | 438 | 1140 |
| 840° C. | 1.2 | 1.7250 | 0.40 | 107 | 63 | 119 | 500 |
| | 2.4 | 1.7600 | 0.47 | 117 | 65 | 121 | 530 |
| | 3.6 | 1.7400 | 0.66 | 255 | 94 | 176 | 710 |
| | 4.8 | 1.5400 | 0.81 | 820 | 230 | 382 | 1000 |
| 880° C. | 0.6 | 1.210* | 0.45 | 95 | | 108 | 390 |
| | 1.2 | 1.5050* | 0.45 | 94 | | 95 | 435 |
| | 2.4 | 1.5800* | 0.57 | 89 | | 103 | 495 |
| | 4.8 | 8.850* | 0.68 | 392 | | | 845 |

*B = For a field of 800 A/m

B1600 = Magnetic induction obtained for a magnetic field of 1,600 A/m

In order to study the metallographic structures, micrographic observations were carried out on samples taken from the strips so that the edge of the rolled strips perpendicular to the rolling direction is observed. On these samples, micrographs were made with etching by immersion for 5 seconds in an iron perchloride bath at room temperature containing (for 100 ml): 50 ml of $FeCl_3$ and 50 ml of water after polishing with 1200 paper and then electrolytic polishing with a bath A2 consisting (for 1 liter) of 78 ml of perchloric acid, 120 ml of distilled water, 700 ml of ethyl alcohol, 100 ml of butylglycol.

These observations were made with an optical microscope with a magnification of 40. It was noticed that for low annealing rates, i.e. 1.2 m per minute, the structure is similar to the one which is observed on materials having undergone static annealing. This is an isotropic crystallized structure. For static annealing, the structure is apparently 100% crystallized and the grain boundaries are perfectly defined. For continuous annealing at 785° C., the structure is partly crystallized (the grain boundaries are not very well defined) and for continuous annealing at 880° C., the structure is more crystallized but the grain boundaries are, however, not sufficiently revealed for determining whether these samples are 100% crystallized.

For the highest rates, i.e. for rates of 2.4 m per minute, 3.6 m per minute and 4.8 m per minute, the micrographs show a very distinct, highly specific structure of the structures obtained by static annealing. This is a structure apparently close to that of the work-hardened metal. The inventors also noticed that the micrographs made on the materials which were annealed continuously at 880° C. at the rate of 4.8 m per minute have a very anisotropic structure (very elongated grains), much more anisotropic than the structure obtained by annealing at 785° C. with a passing speed of 4.8 m per minute.

It thus appears that with continuous heat treatments, it is possible to obtain two types of structure:

on the one hand, an anisotropic specific structure obtained for runs with higher speeds (2.4 m per minute, 3.6 m per minute and 4.8 m per minute). This structure is a restored or partly crystallized structure which may be confirmed by examination with x-rays which shows that the texture is that of a slightly re-crystallized restored material, very similar to the work-hardening texture;

on the other hand, a structure apparently similar to the one which is obtained by static annealing and which corresponds to the continuous annealing at low speed (1.2 m per minute and 0.6 m per minute). This is an entirely crystallized structure which is confirmed by examination with x-rays, with a texture very close to that of the re-crystallized metal in static annealing.

On these different samples, the size of the grains was also determined. As the coercitive field of a magnetic alloy is highly related to the grain size, in order to be able to achieve significant comparisons between two methods for treating the same material, it is necessary to make observations on the materials having equivalent coercitive fields. Also in order to conduct these measurements, samples having close coercitive fields were selected and measurements were carried out on the material which had been subject to static annealing at 760° C. for two hours on the one hand and on the other hand on a material which had been continuously annealed at 880° C. with a passing speed of 1.2 m per minute.

The evaluation of the dimensions of the grains was carried out by means of a piece of equipment for analyzing automatic images allowing detection of the contour of the grains, calculation of the perimeter of each of them, conversion of this perimeter into an equivalent diameter and finally calculation of the surface area of the grain. This device also gives the possibility of obtaining a total number of grains as well as their surface area. Such devices for analyzing automatic images for measuring grains are known per se. In order to obtain results which have satisfactory statistical significance, the measurement has to be carried out on a plurality of sample areas. The dimensional evaluation was made by defining the following grain size classes:

The grains for which the surface area ranges from 10 $\mu m^2$ to 140 $\mu m^2$ by steps of 10 $\mu m^2$.

The grains for which the surface area ranges from 140 $\mu m^2$ to 320 $\mu m^2$ by steps of 20 $\mu m^2$.

The grains for which the surface area ranges from 320 $\mu m^2$ to 480 $\mu m^2$ by steps of 40 $\mu m^2$, The grains for which the size ranges from 480 to 560 $\mu m^2$, the grains for which the size ranges from 560 to 660 $\mu m^2$, the grains for which the size ranges from 660 to 800 $\mu m^2$, the grains for which the size ranges from 800 to 1,000 $\mu m^2$, the grains for which the size ranges from 1,000 to 1,500 $\mu m^2$, and then the grains for which the size exceeds 1,500 $\mu m^2$.

These examinations show that static annealing at 760° C. is characterized by a distribution of the Gaussian type of the grain size with a peak around 150 $\mu m^2$. The grains of this dimension represent 5.5% of the total surface area of an analyzed sample. There are very little large grains and the size of the grains remains less than 750 $\mu m^2$.

On the other hand, the continuously annealed materials exhibit a structure in which there are less grains of small size but more grains of large size between 200 and 1,000 $\mu m^2$. In particular, the grains comprised between 30 and 50 $\mu m^2$ occupy a surface area equivalent to the one occupied by the large grains with a size comprised between 500 $\mu m^2$ and 1,100 $\mu m^2$.

These results show that, although apparently comparable with a structure obtained by static annealing, continuous annealing leads to a very different structure, notably by the distribution of the grain sizes.

Moreover, dimensional evaluations of grains were carried out on four strips with a thickness of 0.34 mm on which continuous annealing at 880° C. was carried out on the one hand under hydrogen at a velocity of 1.2 m per minute and optimization static annealing at 760° C. for two hours under hydrogen on the other hand. These strips correspond to the castings JE686, JE798, JD842, JE799 and JE872, the compositions of which are transferred to Table 3. These examinations show that for these castings, the distribution of the finest grains and notably with a size of less than 80 $m^2$ is very different for the samples having been subject to a static classification annealing at 760° C. from what it is for samples which result from a continuous treatment at 880° C. In particular, the fine grains are much more numerous on the samples having been subject to static annealing than on the samples which have been subject to continuous annealing. It will in particular be noted that for grains of a size of less than 40 $m^2$, the number of grains, per size class, on samples having undergone static annealing is greater than the maximum number of grains obtained on continuously annealed samples. The whole of these results show that, notably with continuous annealing, the distribution of the grain sizes does not have any dominant grain size. The maximum number of grains noted in a grain size class never exceeds 30, unlike in static annealing where the number of grains may attain 160 for a same size class, notably for small grains.

The total number of grains was also determined for each of these samples for a surface area of 44,200 $mm^2$ as well as the average size of the grains. These results are borne by Table 5.

TABLE 5

Size and number of grains obtained for various compositions

| Casting | Annealing | Average size of the grains ($\mu m^2$) | Total number of grains |
|---|---|---|---|
| JD842 | Static 760° C./2 h | 94 | 454 |
| | Continuous 880° C./1.2 m/min | 155 | 260 |
| JE686 | Static 760° C./2 h | 104 | 332 |
| | Continuous 880° C./1.2 m/min | 175 | 204 |
| JE872 | Static 760° C./2 h | 58 | 563 |
| | Continuous 880° C./1.2 m/min | 145 | 243 |
| JE798 | Static 760° C./2 h | 51 | 634 |
| | Continuous 880° C./1.2 m/min | 168 | 211 |
| JE799 | Static 760° C./2 h | 78 | 427 |
| | Continuous 880° C./1.2 m/min | 127 | 243 |

These results notably give the possibility of showing that the samples having been subject to continuous annealing at 880° C. with a rate of 1.2 m per minute have an average grain size of more than 110 $\mu m^2$ and an average number of grains of less than 300, while the samples having been subject to static annealing at 760° C. for two hours have average grain sizes of less than 110 $\mu m^2$ and a number of grains of more than 300. These characteristics allow identification or clear distinction of the structures obtained by continuous annealing on the one hand, and by static annealing on the other hand. In a more general way, the inventors noticed that the types of treatment may be distinguished by following the grain size characteristics:

either the structure is of the «partly crystallized», type, i.e. on at least 10% of the surface of samples observed with a microscope with ×40 magnification after chemical etching with iron perchloride, it is not possible to identify grain boundaries;

or the structure is of the «crystallized» type, i.e. on at least 90% of the surface of samples observed under the microscope with ×40 magnification after chemical etching with iron perchloride, it is possible to identify a network of grain boundaries and within the range of grain sizes from 0 to 60 $\mu m^2$, there exists at least one class with a grain size width of 10 $\mu m^2$ comprising at least twice more grains than the same grain size class corresponding to the observation of a comparable cold rolled strip having the same composition, not having been subject to continuous annealing but having been subject to static annealing at a temperature such that the difference between the coercitive field obtained with static annealing and the coercitive field obtained with continuous annealing is less than half of the value of the coercitive field obtained by continuous treatment and, in the range of grain sizes from 0 to 60 $\mu m^2$, there exists at least one size of a grain class with a width of 10 $m^2$, for which the ratio of the number of grains to the total number of grains observed on the sample having been subject to continuous annealing is greater by at least 50% than the same ratio corresponding to a sample taken on the comparable cold rolled strip having undergone static annealing.

On these samples, cutting out tests were also made. For this, stators were cut out from samples which, according to the invention, were continuously annealed at temperatures of 785° C., 800° C., 840° C., with running speeds of 1.2 m per minute for a useful oven length of 1.2 m, which corresponds to a dwelling time of one minute at the annealing temperature. These cut outs were carried out on industrial cutting-out installations by punching using a punch and a die. The cuts were made on strips with a thickness of 0.20 mm and 0.35 mm.

The quality of the cut out was determined by evaluating the cutting radius and the presence or absence of burrs. The results are transferred to Table 6. Upon reading it, it appears that, regardless of the thickness and regardless of the continuous annealing temperature, the quality of the cut out is satisfactory according to customary criteria corresponding to the requirements of the customers.

In Table 6, «close to the work-hardened state», means that the number of burrs is substantially equal, or even slightly greater than the number of burrs ascertained in the work-hardened state, while «greater than the work-hardened state» means that the number of burrs is still slightly greater, while remaining acceptable according to the customary criteria corresponding to the requirements of customers.

The deformations after quality heat treatment on the cut out parts were also examined.

Indeed, for certain parts and notably for E-shaped parts, it is noticed that the final treatment carried out on parts obtained by a method according to the prior art may lead to deformations which probably result from recrystallization and from the transformation of the rolling texture into a recrystallization texture. These deformations lead to dimensional variations of the order of a few tenths of mm which are not acceptable. For E-shaped profiles, for example where the legs of the E have a length of several tens of cm, which is large relatively to the other dimensions of the E, variations in the distance between neighboring legs after optimization annealing are observed, which are of the order of 1 to 5 mm between the top and the bottom of the legs.

On the contrary, with the continuously annealed alloy according to the present invention and which is in a crystallized or partly crystallized state, an additional optimization static annealing of the magnetic properties—typically at 850° C. for three hours—generally does not have any significant incidence on the geometry of the parts.

Tests on E-shaped parts have shown that the dimensional variations resulting from the magnetic optimization static annealing remained less than 0.05 mm in the previous example of E-shaped profiles, which is quite acceptable.

In order to specify the roles of the annealing temperature and of the cooling rate of the strip upon exiting the treatment oven, tests were carried out on an alloy of a standard grade AFK502R containing 48.63% Co-1.98% V-0.14% Ni-0.04% Nb-0.007% C (Casting JD173), the remainder being iron and impurities.

TABLE 6

Cutout tests

| Casting | Thickness (mm) | Continuous annealing temperature | Hardness Hv0.2 | Cutout radius relatively to the work-hardened state | Burrs | Customer validation |
|---|---|---|---|---|---|---|
| JD414 | 0.20 mm | 785° C. | 185 | NTR | NTR | Ok |
| | | 800° C. | 180 | NTR | NTR | Ok |
| | | 840° C. | 173 | NTR | NTR | Ok |
| | 0.35 mm | 785° C. | 179 | Greater | Close to the work-hardened state | Ok |
| | | 800° C. | 176 | Less pronounced | Greater than the work-hardened state | Ok |
| | | 840° C. | 172 | Less pronounced | Greater than the work-hardened state | Ok |

This alloy was made in the form of cold rolled strips of different thicknesses, and then subject to continuous annealing by having them pass at a constant speed in an oven under a protected atmosphere, at plateau temperatures equal to 700° C., 750° C., 800° C., 850° C., 900° C. or 950° C., for a plateau time equal to 30 s, 1 min or 2 mins.

After this annealing, the strips were cooled down to a temperature below 200° C., at cooling rates comprised between 600° C./h and 35,000° C./h.

Further, as a comparison, certain strips were cooled at a cooling rate of only 250° C./h.

The possibility of cutting out annealed strips, and more generally their embrittlement towards application operations, including shaping operations, were tested by cutting out tensile specimens and washers with inner and outer diameters of 26 mm and 35 mm respectively in thin strips obtained after cooling.

The specimens were subject to a standardized strip embrittlement test according to the IEC 404-8-8 standard. This test consists of bending the flat specimen to 90° alternatively from each initial position, according to a device and a procedure described in the ISO7799 standard. The bending radius selected by the IEC 404-8-8 standard for extra thin metal sheets (of type FeCo) used in medium frequencies is of 5 mm. Bending to 90° from the initial position with return to the initial position accounts for one unit. The test is stopped upon appearance of the first crack visible to the naked eye in the metal. The last bending is not counted. The tests were carried out at 20° C. on sheet bars with a width of 20 mm in FeCo alloy, by slow and uniform movement of alternating bending.

These tests were interrupted after 20 bendings. Thus, a number of folds equal to 20 means that the corresponding sample withstands at least 20 bendings.

In parallel, the samples in the form of plates were subject to a cutting out test, on industrial cutting installations by punching using a punch and a die. The quality of the cutting out was determined by evaluating the cut-out radius and by examining the edge for determining the burrs and the metal thickness proportion which yielded by transgranular failure without notable plastic elongation of the material (origin of the cut-out burrs).

From these tests, the capability of cutting out these samples was described as very good (VG), good (G), average (AVG) or poor (P).

Very good cutting out capability corresponds to metal cut out with a reduced press force relatively to what is known in the state of the art on a work-hardened FeCo alloy, to a cut-out zone without any burr and to a higher thickness proportion with transgranular failure.

Good cutting-out capability corresponds to metal cut out with a high press force and compliant with what is known in the state of the art on a FeCo alloy. In this metallurgical state (work-hardened or even a little restored) the strip is very elastic and resistant and considerably deforms before the punch begins its penetration, and as well as during the penetration with a very large press force. The cut-out zone is achieved by total transgranular failure without any burr with very great elastic return of the strip after perforation.

Medium cutting-out capability corresponds to an alloy for which cutting-out is easy but the cut-out zone becomes irregular and burrs or detachments of metal appear on the exit phase of the punch.

The cutting-out capability is described as poor when cracks appear around the punch before the latter has finished perforating the metal sheet. The beginning of elastically pressing the strip with the punch may be sufficient for generating cracking and failure of the sample.

On these materials, in the state posterior to the annealing described above, high temperature annealing or so called «optimization static annealing» intended for optimizing the magnetic characteristics was also carried out. This annealing was made on washers during static annealing at a temperature of 850° C. for three hours.

These tests gave the possibility of obtaining the results transferred to Table 7, wherein:

$T_p$ is the plateau time in min,

E is the thickness of the strip in mm,

T is the annealing temperature in ° C., $V_R$ is the cooling rate down to a temperature below 200° C. in ° C./h, He is the coercitive field in A/m, Nplis is the number of folds before failure, Dec. is the cutting-out capability, $R_{p0.2}$ is the conventional elasticity limit measured in pure traction on standardized samples in MPa, Losses (1) are the magnetic losses in W/kg dissipated by the induced currents when the sample is subject to a variable magnetic field which, in the present case is an alternating field with a frequency of 400 Hz inducing alternating sinusoidal induction by the use of an electronic servo-control of the applied magnetic field, known per se to one skilled in the art, for which the maximum value is 2 Teslas. In the case (1), the metal has only been subject to continuous annealing.

Losses (2) are the magnetic losses in W/kg after optimization annealing, posterior to the continuous annealing.

TABLE 7

Effect of the annealing temperature and of the cooling rate of the strip upon exiting the oven on the mechanical and magnetic properties

| No. | $T_p$ (min) | e (mm) | $V_R$ (° C./h) | T (° C.) | Hc (A/m) | Nplis | Dec. | $R_{p0.2}$ (MPa) | Losses (W/kg) at 400 Hz (1) | Losses (W/kg) at 400 Hz (2) |
|---|---|---|---|---|---|---|---|---|---|---|
| 1 | 1 | 0.2 | 35 000 | 700 | 1512 | >20 | B | 1270 | 590 | 35 |
| 2 | 1 | 0.2 | 35 000 | 750 | 1114 | >20 | TB | 1030 | 445 | 34.5 |
| 3 | 1 | 0.2 | 35 000 | 800 | 796 | >20 | TB | 850 | 335 | 35 |
| 4 | 1 | 0.2 | 35 000 | 850 | 175 | >20 | TB | 490 | 123 | 34.5 |
| 5 | 1 | 0.2 | 35 000 | 900 | 143 | >20 | TB | 470 | 108 | 37 |
| 6 | 1 | 0.2 | 35 000 | 950 | 271 | >20 | TB | 540 | 146 | 44 |
| 7 | 1 | 0.2 | 5 000 | 700 | 1512 | >20 | B | 1250 | 575 | 35.5 |
| 8 | 1 | 0.2 | 5 000 | 750 | 955 | >20 | TB | 920 | 398 | 36 |

TABLE 7-continued

Effect of the annealing temperature and of the cooling rate of the strip upon exiting the oven on the mechanical and magnetic properties

| No. | $T_p$ (min) | e (mm) | $V_R$ (° C./h) | T (° C.) | Hc (A/m) | Nplis | Dec. | $R_{p0.2}$ (MPa) | Losses (W/kg) at 400 Hz (1) | Losses (W/kg) at 400 Hz (2) |
|---|---|---|---|---|---|---|---|---|---|---|
| 9 | 1 | 0.2 | 5 000 | 800 | 716 | >20 | TB | 810 | 302 | 34 |
| 10 | 1 | 0.2 | 5 000 | 850 | 159 | >20 | TB | 480 | 101 | 34.5 |
| 11 | 1 | 0.2 | 5 000 | 900 | 127 | >20 | TB | 460 | 87 | 35 |
| 12 | 1 | 0.2 | 5 000 | 950 | 255 | >20 | TB | 520 | 142 | 42 |
| 13 | 1 | 0.2 | 1 000 | 800 | 581 | >20 | TB | 725 | 262 | 34.5 |
| 14 | 1 | 0.2 | 600 | 800 | 406 | 17 | MO | 622 | 193 | 34 |
| 15 | 1 | 0.2 | 600 | 850 | 143 | 15 | MO | 463 | 105 | 35 |
| 16 | 1 | 0.2 | 250 | 700 | 1194 | >20 | B | 1150 | 513 | 34.5 |
| 17 | 1 | 0.2 | 250 | 750 | 279 | 7 | MA | 540 | 152 | 34 |
| 18 | 1 | 0.2 | 250 | 800 | 199 | 4 | MA | 500 | 129 | 35 |
| 19 | 1 | 0.2 | 250 | 850 | 127 | 3 | MA | 460 | 85 | 35 |
| 20 | 1 | 0.2 | 250 | 900 | 103 | 4 | MA | 430 | 80 | 38 |
| 21 | 1 | 0.2 | 250 | 950 | 191 | 4 | MA | 490 | 125 | 45 |
| 22 | 1 | 0.35 | 35 000 | 800 | 915 | >20 | TB | 910 | 432 | 71 |
| 23 | 1 | 0.35 | 5 000 | 800 | 772 | >20 | TB | 830 | 369 | 70.5 |
| 24 | 1 | 0.35 | 250 | 800 | 223 | 3 | MA | 505 | 159 | 71 |
| 25 | 1 | 0.1 | 35 000 | 800 | 676 | >20 | TB | 795 | 274 | 28 |
| 26 | 1 | 0.1 | 5 000 | 800 | 581 | >20 | TB | 730 | 241 | 27.5 |
| 27 | 1 | 0.1 | 250 | 800 | 1432 | 3 | MA | 470 | 79 | 28 |
| 28 | 0.5 | 0.2 | 5 000 | 800 | 1353 | >20 | B | 1180 | 535 | 24.5 |
| 29 | 0.5 | 0.2 | 600 | 800 | 836 | 5 | MA | 880 | 344 | 35.5 |
| 30 | 2 | 0.2 | 5 000 | 800 | 302 | >20 | TB | 560 | 161 | 35 |
| 31 | 2 | 0.2 | 250 | 800 | 119 | 4 | MA | 450 | 84 | 34.5 |
| 32 | 0.5 | 0.35 | 5 000 | 800 | 1432 | >20 | B | 470 | 519 | 71.5 |
| 33 | 0.5 | 0.35 | 250 | 800 | 931 | 5 | MA | 920 | 442 | 71 |
| 34 | 2 | 0.35 | 5 000 | 800 | 326 | >20 | TB | 590 | 199 | 71.5 |
| 35 | 2 | 0.35 | 250 | 800 | 143 | 4 | MA | 475 | 131 | 71.5 |

From these tests, the following experimental relationship was shown, which associates the number of folds before failure and the capability of being cut out of the materials in a press:

- a number of folds greater than or equal to 20 obtained subsequently to continuous annealing at a plateau temperature greater than or equal to 720° C. with a plateau time of more than 30 seconds is associated with very good cutting-out capability (tests 2-6, 8-13);
- a number of folds greater than or equal to 20 obtained subsequently to continuous annealing at a plateau temperature of less than 720° C. or a plateau time less than or equal to 30 seconds is associated with good cutting-out capability (tests 1, 7, 16, 28, 32);
- a number of folds comprised between 15 and 20 is associated with average cutting-out capability, which is still acceptable;
- a number of folds of less than 15 is associated with poor cutting-out capability, to be avoided.

Thus, only the conditions with which cutting-out capabilities from «average» to «very good», may be obtained, therefore materials having withstood at least 15 successive bendings without failure, are retained.

Moreover, these tests show that surprisingly, the cooling rate upon exiting continuous annealing controls the capability of being cut out of the annealed strip, and more generally its embrittlement towards application operations, the critical limit being located around 600° C./h.

Further the following points occur.

At high cooling rates (35,000 and 5,000° C./h) the metal systematically has—at least—good cutting-out capability, or even very good cutting-out capability for partly or totally recrystallized materials, i.e. subject to continuous annealing temperatures of at least 710° C. Below 710° C. (tests 1 and 7), it would also be possible by increasing the plateau time to obtain partial recrystallization, but this plateau time should be of a significant duration, not very compatible with performing industrial continuous annealing. An annealing temperature above 700° C., or even above 720° C., is therefore favorable.

At 1,000° C./h and especially 600° C./h, the cutting-out capability degrades, but it still remains sufficient. On the other hand, in all the cases tested at 250° C./h, the strip breaks after a very small number of folds (often less than 5), which clearly shows that the materials become more brittle and are not able to be cut out.

It is considered that a cooling rate of at least 600° C./h gives the possibility of obtaining a strip with satisfactory cutting-out capability.

This controlling of the cutting-out capability by controlling the cooling rate upon exiting industrial continuous annealing is not only confirmed for a strip thickness of 0.2 mm, but also for thicknesses of 0.1 mm and 0.35 mm, leading to the same ductile/brittle limit for a rate of about 600° C./h.

For short plateau times, of less than 3 mins, and annealing temperatures below 720° C. (tests 1, 7 and 16), the coercitive fields of the obtained materials are very high, of at least 15 Oe, which corresponds to materials which are mainly work-hardened and restored, without any significant crystallization. Nevertheless, the magnetic losses exceed 500 W/kg. It is therefore preferable to apply plateau temperatures greater than or equal to 720° C., giving the possibility of obtaining, for plateau times of less than 3 mins, limited magnetic losses (less than 500 W/kg for a strip thickness of 0.2 mm).

Thus, the magnetic strips according to the invention advantageously have for a thickness comprising between 0.05 mm and 0.6 mm, magnetic losses of less than 500 W/kg, preferably less than 400 W/kg.

It is also noticed that incursions to too high temperatures located in the austenitic domain by continuous annealing (annealing temperatures above 900° C., tests 6, 12 and 21) significantly degrade the magnetic losses after additional annealing at 850° C./3 h. Also continuous annealings are more performing if their plateau temperature is sufficiently far from 950° C.

Annealings at 900° C. do not modify or only very little the magnetic losses after additional static annealing for 3 h as compared with lower temperatures. Thus, it is considered that the most relevant plateau temperature area is comprised between 720° C. and 900° C.

Moreover, in addition to the important criterion of resisting to the cutting out of annealed metal sheets, it is also important to produce magnetic materials having limited magnetic losses both with regard to energy yield aspects of the machines and localized heating thermal aspects.

Two points are thus distinguished.

Notably, the method according to the invention gives the possibility of directly obtaining products (such as stators or rotors) cut out from the annealed strip, already having the desired mechanical performances of the HEL type with necessarily degraded magnetic losses which correspond to them. However, the magnetic losses should remain at a level so that it is possible to dissipate the heat at the rotor: typically the magnetic losses at 2 T/400 Hz for a thickness of 0.2 mm should be less than 500 W/kg, and preferably less than 400 W/kg. The method according to the invention actually allows such values to be attained.

Moreover, while the method according to the invention gives the possibility of cutting out all the parts in the continuous annealed state with a predefined and high elastic limit for example consistent with the requirements of the rotor, it is necessary to apply after the cutting out, specifically to the cut out stator parts, annealing for optimizing the magnetic properties (of the type 850° C./3 h under pure $H_2$), the stator generally and mainly needing very low magnetic losses. Now, it is important that the strips provided after continuous annealing may restore, after additional optimization annealing, the same very low magnetic losses as those which they would have had directly with the optimization annealing alone. These very low losses are of the order of 35 W/kg at 2 T/400 Hz for a strip thickness of 0.2 mm, 71 W/kg for a strip thickness of 0.35 mm and 28 W/kg for a strip thickness of 0.1 mm in the case of industrial and commercial grades Fe-49% Co-2% V-0 to 0.1% Nb-0.003 to 0.02% C not re-melted after a first elaboration in an ingot. Thus, it is desirable that after applying additional annealing of 850° C./3 h to the strips stemming from the continuous annealing, the losses do not exceed more than 20% of the magnetic losses which are noted at the end of a single static «conventional» annealing of 850° C./3 h. The method according to the invention also gives the possibility of attaining such performances.

In order to study the potential of influence of the composition of the alloy on the mechanical and magnetic properties, tests similar to those described with reference to Table 7, for various alloy compositions were conducted. For these tests, the continuous annealing was achieved at 850° C., with a plateau time of 1 min, and followed by cooling at 5,000° C./h, under $H_2$.

The chemical compositions of the samples used, as well as the obtained properties are transferred to Table 8. In this table, Js designates the magnetization at saturation, expressed in Teslas.

TABLE 8

Influence of the composition on the mechanical and magnetic properties (1)

| Sample | A | B | C | D | E | F | G | H |
|---|---|---|---|---|---|---|---|---|
| C | 0.007 | 0.012 | 0.009 | 0.008 | 0.093 | 0.011 | 0.008 | 0.017 |
| Mn | 0.024 | 0.042 | 0.037 | 0.23 | 0.1 | 0.023 | 0.23 | 0.16 |
| Si | 0.045 | 0.037 | 0.42 | 0.09 | 1.7 | 0.062 | 0.09 | 0.31 |
| S | 0.0021 | 0.0027 | 0.0075 | 0.0021 | 0.0018 | 0.0017 | 0.0021 | 0.0016 |
| P | 0.0033 | 0.0025 | 0.0028 | 0.0041 | 0.0023 | 0.0035 | 0.0041 | 0.0026 |
| Ni | 0.14 | 0.18 | 0.12 | 0.09 | 0.08 | 0.022 | 0.09 | 3.7 |
| Cr | 0.026 | 0.036 | 0.032 | 0.017 | 0.67 | 0.012 | 0.017 | 0.32 |
| Mo | <0.005 | <0.005 | <0.005 | <0.005 | <0.005 | <0.005 | <0.005 | <0.005 |
| Cu | 0.011 | 0.01 | 0.088 | 0.033 | 0.037 | 0.026 | 0.033 | 0.027 |
| Co | 48.63 | 48.61 | 48.52 | 50.05 | 27.05 | 48.72 | 50.05 | 48.69 |
| V | 1.98 | 1.59 | 2.03 | 0.98 | 0.04 | 1.55 | 1.4 | 1.92 |
| Al | <0.005 | <0.003 | <0.004 | <0.004 | <0.004 | <0.004 | <0.004 | <0.004 |
| Nb | 0.04 | 0.119 | 0.31 | 0.006 | 0.16 | 0.003 | 0.006 | 0.04 |
| Ti | <0.005 | 0.0015 | 0.009 | 0.0013 | <0.0005 | <0.005 | 0.0013 | 0.0015 |
| $N_2$ | 0.0046 | 0.0027 | 0.0017 | 0.0034 | 0.0038 | 0.0043 | 0.0034 | 0.0048 |
| Ta | <0.0008 | 0.058 | 0.032 | 0.032 | <0.0008 | <0.0008 | <0.0008 | <0.0008 |
| Zr | <0.0008 | <0.0008 | <0.0008 | <0.0008 | <0.0008 | <0.0008 | 0.32 | <0.0008 |
| B | <0.0006 | <0.0005 | 0.005 | 0.04 | <0.0006 | <0.0006 | 0.0007 | 0.0013 |
| Fe | 48.9 | 49.1 | 47.915 | 48.15 | 71.94 | 48.56 | 47.74 | 44.8 |
| W | <0.005 | <0.005 | <0.005 | <0.005 | <0.005 | 0.6 | <0.005 | <0.005 |
| Js (T) | 2.35 | 2.36 | 2.32 | 2.37 | 2.28 | 2.34 | 2.36 | 2.26 |
| Hc (A/m) | 159 | 541 | 668 | 772 | 414 | 151 | 271 | 127 |
| Nplis | >20 | >20 | >20 | >20 | >20 | >20 | >20 | >20 |
| Dec. | VG | VG | VG | VG | VG | VG | VG | VG |
| R0.2 (MPa) | 480 | 845 | 960 | 1045 | 625 | 530 | 640 | 530 |
| Losses (W/kg) at 400 Hz (1) | 101 | 245 | 295 | 334 | 197 | 102 | 146 | 93 |
| Losses (W/kg) at 400 Hz (2) | 34.5 | 38 | 42 | 45 | 81 | 36 | 38.5 | 33 |
| Inv? | YES | YES | YES | YES | YES | YES | YES | YES |

All the compositions of this table are compliant with the invention.

Example A corresponds to an alloy of the same composition as the one used for the tests given in Table 7. Example A is therefore identical to test 10 of this Table 7.

Example B integrates a lowering of the percentage of vanadium and additions of niobium and tantalum, the latter being used for replacing the moderator role of the ordering of vanadium, while niobium is a growth inhibitor giving the possibility of limiting germination of the recrystallization and the grain growth together with continuous annealing. It is thus seen that the performances are in the range of the targeted properties and at the same time shifted towards higher elastic limits and magnetic losses as compared with example A.

Example C contains more Si, S, Nb, Ta and B as the reference alloy A while being compliant with the range of targeted properties: the moderately added silicon hardens a little of the metal by its presence in a solid solution while boron and sulfur precipitate at the grain boundaries and niobium slows down crystallization/growth. This generates strong slowing down of crystallization, visible on the larger elastic limit, as well as on an acceptable increase in the magnetic losses.

Example D shows stronger additions of Mn and B while tantalum remains at the same level in the alloy C, and vanadium is lowered to 1%. The performances are always compliant with the invention. The much stronger addition of boron causes strong trapping of germs and grain boundaries which further increases the elastic limits and magnetic losses.

Example E has undergone strong additions of C, Si, Cr and Nb while the cobalt percentage is reduced to 27%, which makes it a substantially less magnetically performing alloy, but also much less expensive. The percentage of vanadium is reduced to a very low level since there is no longer any embrittlement ordering for such a percentage of cobalt. The obtained magnetic performances still remain in the targeted property range, even if the magnetic losses after additional magnetic optimization annealing attain a quite high level (81 W/kg) but nevertheless compliant with the targeted properties (<100 W/kg).

In example F, a portion of vanadium is replaced with tungsten, by comparison with the reference alloy A. The performances are only changed very little and in any case remain in the range of the sought properties.

In example G, a portion of vanadium is replaced with zirconium. As Zr is an inhibitor of germination and grain growth, a little less powerful than Nb, it is seen that the elastic limit and magnetic loss values are increased (relatively to alloy A), and in any case within the spectrum of the targeted properties.

In example H more than 3% of Ni is added which is known to further increase the ductility of the material as well as the electric resistivity. However, the magnetization at saturation is reduced but still compliant with the invention, like all the other characterized properties.

As a comparison, similar tests were conducted for alloy compositions non-compliant with the invention.

The chemical compositions of the samples used, as well as the obtained properties are transferred to table 9.

TABLE 9

Influence of the composition on the mechanical and magnetic properties (2)

| Sample | I | J | K | L | M | N | O | P |
|---|---|---|---|---|---|---|---|---|
| C | 0.008 | 0.012 | 0.008 | 0.013 | 0.001 | 0.007 | 0.0011 | 0.0016 |
| Mn | 0.22 | 0.013 | 0.028 | 0.067 | 0.011 | 0.019 | 0.028 | 0.022 |
| Si | 0.033 | 0.017 | 0.13 | 0.039 | 3.2 | 0.03 | 0.019 | 0.033 |
| S | 0.0028 | 0.0018 | 0.0017 | 0.0031 | 0.0019 | 0.0037 | 0.0022 | 0.0012 |
| P | 0.0027 | 0.0037 | 0.0023 | 0.0025 | 0.0022 | 0.0041 | 0.0038 | 0.0024 |
| Ni | 0.1 | 0.14 | 0.11 | 0.16 | 0.16 | 0.23 | 0.18 | 6.03 |
| Cr | 0.025 | 0.052 | 3.52 | 3.8 | 0.031 | 0.049 | 0.016 | 0.011 |
| Mo | <0.005 | 0.025 | <0.005 | <0.005 | <0.005 | <0.0050 | <0.005 | <0.005 |
| Cu | 0.018 | 0.032 | 0.022 | 0.018 | 0.031 | 0.011 | 0.017 | 0.012 |
| Co | 15.1 | 48.64 | 48.59 | 48.49 | 48.67 | 48.58 | 48.81 | 48.71 |
| V | <0.005 | 3.81 | <0.005 | 1.93 | <0.005 | 1.97 | 1.93 | 1.98 |
| Al | <0.005 | <0.005 | <0.005 | <0.005 | <0.005 | <0.005 | <0.005 | <0.005 |
| Nb | <0.001 | <0.001 | <0.001 | <0.001 | <0.001 | 0.65 | <0.001 | <0.001 |
| Ti | <0.005 | <0.005 | <0.005 | <0.005 | <0.005 | <0.005 | <0.005 | <0.005 |
| N2 | 0.0038 | 0.0029 | 0.0031 | 0.0044 | 0.0028 | 0.0024 | 0.0018 | 0.0028 |
| Ta | <0.0008 | <0.0008 | <0.0008 | <0.0008 | <0.0008 | <0.0008 | <0.0008 | <0.0008 |
| Zr | <0.0008 | <0.0008 | <0.0008 | <0.0008 | <0.0008 | <0.0008 | <0.0008 | <0.0008 |
| B | <0.0006 | <0.0006 | <0.0006 | <0.0006 | <0.0006 | <0.0006 | 0.11 | <0.0006 |
| Fe | 84.49 | 47.25 | 47.585 | 45.47 | 47.89 | 50.41 | 48.88 | 43.19 |
| W | <0.005 | <0.005 | <0.005 | <0.005 | <0.005 | <0.005 | <0.005 | <0.005 |
| Js (T) | 2.22 | 2.29 | 2.26 | 2.21 | 2.23 | 2.33 | 2.34 | 2.23 |
| Hc (A/m) | 143 | 955 | 255 | 382 | 163 | 446 | 573 | 836 |
| Nplis | 20 | 18 | 1 | 20 | 2 | 20 | 1 | 20 |
| Dec. | VG | G | P | VG | P | VG | P | VG |
| R0.2 (MPa) | 485 | 526 | 509 | 497 | 577 | 620 | 823 | 580 |
| Losses (W/kg) (1) | 146 | 442 | 123 | 162 | 88 | 213 | 268 | 395 |
| Losses (W/kg) (2) | 127 | 373 | 32 | 25 | 28 | 143 | 77 | 328 |
| Inv? | NO | NO | NO | NO | NO | NO | NO | NO |

Example I, for which the composition comprises 15% of Co, saturated Js=2.22 T which is below the desired minimum limit of 2.25 T. This shows the benefit of having a minimum of 18% of Co. Indeed, FeCo alloys are sought for their high magnetization at saturation which allows them to reduce the masses and volumes of electro-technical machines in on board systems (space, aeronautics, railways, automobiles, robotics . . . ).

The composition according to the example J contains 3.8% of vanadium, which exceeds the maximum limit of 3% V+W. With such a percentage, one substantially penetrates into the biphasic domain $\alpha+\gamma$, which generates strong degradation of the magnetic performances after additional annealing or optimization of the performances (850° C./3 h), by placing them well above the desired limit of 100 W/kg.

The composition according to example K contains 3.5% of chromium, but no vanadium, which allows it to exhibit sufficient magnetization at saturation (2.26 T) but a very poor capability of bending and of being cut out. This is due to the fact that unlike vanadium, chromium does not have the capability of slowing down the embrittlement ordering of FeCo around 50% Co+/−25%. The hot rolled and then cold rolled strips and then continuously annealed are therefore brittle.

Example L circumvents the previous problem by reintroducing 2% of vanadium, like in the reference alloy A, with further, and like in the previous example K, a chromium percentage of more than 3%. The metal becomes ductile and capable of being cut out after continuous annealing, but the addition level of non-magnetic elements is too high and by dilution of the atomic magnetic movements of iron and of cobalt, the magnetization at saturation Js becomes less (2.21 T) than the lower limit required of 2.25 T.

The composition according to example M does not contain any vanadium but contains 3.2% of silicon. With such a percentage, the alloy is no longer in any way ductile, since silicon does not slow down the embrittlement ordering as vanadium does. On the contrary, silicon hardens the alloy and embrittles it by a trend towards ordering to the stoichiometric compound $Fe_3Si$. Further, a percentage of 3.2% of silicon has the magnetization at saturation Js below the minimum limit of 2.25 T (indeed Si is a non-magnetic element and therefore dilutes the magnetic moments of Fe and Co).

The composition according to example N contains 2% of vanadium, just like the reference alloy A, and further contains 0.65% of niobium, which is greater than the limit of 0.5% according to the invention. Now, niobium is known not only as a powerful inhibitor of germination, recrystallization and grain growth, but also as a generator of Nb carbonitrides and of Laves phases $(Fe,Co)_2Nb$, when the percentage of niobium becomes significant. These phases and precipitates further slow down the migration of the grain boundaries, but especially deteriorate the magnetic properties by effective anchoring of Bloch's walls. This causes high losses (143 W/kg) after additional annealing for optimizing the magnetic performances.

The composition according to example O contains 0.11% of boron, i.e. well above the maximum boron limit according to the invention (0.05%). This causes very large embrittlement of the material to bending and a poor capability of being cut out: the precipitation of Fe and Co borides is such that the grains are embrittled and the metal has lost any ductility.

Example P explores the substantial addition of nickel (6.03%) while the composition moreover remains very similar to the reference alloy A: not only the magnetization at saturation becomes too small (2.23 T<2.25 T the minimum), but the magnetic losses after additional annealing for optimizing the magnetic performances (850° C./3 h) become very high (328 W/kg). Nickel actually stabilizes the $\gamma$ phase and such an alloy causes the strong presence of a non-magnetic $\gamma$ phase in the midst of the ferromagnetic ferritic phase. The material is accordingly not very soft magnetically and the magnetic losses are highly substantial.

The tests of the tables above show that the method according to the invention gives the possibility of producing by industrial continuous annealing a thin FeCo strip which may be cut into a complex shape, for example with a press, while giving the possibility of obtaining elastic limits in a very wide possible range—typically from 450 to 1,150 MPa—without exceeding losses at 2 T/400 Hz of 500 W/kg (for a thickness of 0.2 mm), and preferably less than 400 W/kg, while guaranteeing that the very low magnetic losses may be again found after an additional static conventional annealing at 850° C.

These properties are obtained if:

the chemical composition is compliant with the invention, the cooling rate of the metal upon exiting continuous annealing and determined between the plateau temperature and 200° C., is of at least 600° C./h, and preferably at least 1,000° C./h, the plateau temperature is of at least 700° C., preferably at least 720° C., the plateau temperature is of at most 900° C.

Finally, aging tests were carried out at 200° C. with maintaining times of 100 hours and of cumulated 100 hours+500 hours. These tests were conducted at 200° C. because this temperature approximately corresponds to the maximum temperature to which may be subject materials forming the yokes of rotating electro-technical machines used under normal operating conditions. For this, tests are made with an alloy of the AFK502R type for two standard grades corresponding to static annealings of 760° C. for two hours and of 850° C. for three hours, and for strips according to the invention corresponding to continuous annealings at the temperature of 880° C. for three passage speeds: 1.2 m per minute, 2.4 m per minute and 4.8 m per minute in an oven having a useful length of 1.2 m. During these tests, B1600 (the magnetic induction for a field of 1600 A/m), the Br/Bm ratio of the magnetic remnant induction to the maximum magnetic induction and the coercitive field $H_C$ were measured. The results are transferred to Table 10.

TABLE 10

Aging tests

| Annealing | Aging duration at 200° C. | B1600 (Tesla) | Br/Bm | Hc (A/m) |
|---|---|---|---|---|
| Static at 760° C./2 h | 0 h | 2.2070 | 0.71 | 97 |
| | 100 h | 2.1700 | 0.75 | 102 |
| | 100 h + 500 h | 2.1600 | 0.75 | 107 |
| Static at 850° C./3 h | 0 h | 2.2500 | 0.62 | 45 |
| | 100 h | 2.1850 | 0.68 | 58 |
| | 100 h + 500 h | 2.2000 | 0.69 | 58 |
| Continuous at 880° C. v = 1.2 m/min | 0 h | 1.8200 | 0.55 | 83 |
| | 100 h | 1.7700 | 0.48 | 88 |
| | 100 h + 500 h | 1.7750 | 0.49 | 85 |
| Continuous at 880° C. v = 2.4 m/min | 0 h | 1.7650 | 0.41 | 96 |
| | 100 h | 1.8250 | 0.57 | 75 |
| | 100 h + 500 h | 1.8350 | 0.59 | 74 |
| Continuous at 880° C. v = 4.8 m/min | 0 h | 1.6450 | 0.82 | 684 |
| | 100 h | 1.6650 | 0.83 | 652 |
| | 100 h + 500 h | 1.6600 | 0.83 | 644 |

The results show that for static annealed samples, the induction B for a field of 1,600 A/m decreases by 2% subsequently to the annealing, while the coercitive field He increases by 10% (heat treatment at 760° C.) or by 25% (heat treatment at 850° C.).

For the continuously annealed samples, the induction B for a field of 1,600 A/m, varies by at most 2% subsequently to the annealing and the coercitive field He by at most 23%.

These results show that the continuously annealed alloys are not more sensitive to aging than the static annealed alloys. Thus, with an alloy as defined above, i.e. containing 18 to 55% of Co, 0 to 3% of V+W, 0 to 3% of Cr, 0 to 3% of Si, 0 to 0.5% of Nb, 0 to 0.05% of B, 0 to 0.1% of C, 0 to 0.5% of Ta+Zr, 0 to 5% of Ni, 0 to 2% of Mn, the remainder being iron and impurities resultant from the elaboration and notably an alloy of the AFK502R type, it is possible to manufacture magnetic components and notably magnetic shields, by cutting out by mechanical cutting, parts in continuously annealed cold rolled strips in order to obtain the desired mechanical characteristics taking into account the contemplated application and, according to this application, by carrying out or not carrying out on the optionally assembled cut-out parts, complementary quality annealing intended to optimize the magnetic properties of the alloy.

For each application and each particular alloy, one skilled in the art knows how to determine the desired mechanical and magnetic characteristics, as well as determine the particular conditions of the various heat treatments which allows them to be obtained. Of course, the cold-rolled strips are obtained by cold-rolling hyper-quenched hot-rolled strips in order to attain an essentially disordered structure. One skilled in the art knows how to manufacture such hot-rolled strips.

Further, an oxidation heat treatment may be carried out in order to ensure electric isolation of the parts of a stack as this is known to one skilled in the art.

One skilled in the art will understand the benefit of this method which on the one hand allows reduction in the number of alloy grades required for meeting the diverse needs of the users, and on the other hand very significantly reducing the number of static heat treatments to be carried out on the cut-out parts.

Moreover, one skilled in the art will understand that the indicated chemical compositions only define with a lower limit and an upper limit the elements which have to be present. The lower limits of the contents of optionally present elements have been set to 0%, it being understood that these elements may always be present at least as trace amounts, more or less detectable with known analysis means.

SEQUENCE LISTING

Not Applicable

What is claimed is:

1. A continuously annealed strip in a cold rolled soft magnetic alloy, with a thickness of less than 0.6 mm, consisting of an alloy, the chemical composition of the alloy comprising by weight:

| |
|---|
| 18% ≤ Co ≤ 55% |
| 0% ≤ V + W ≤ 3% |
| 0% ≤ Cr ≤ 3% |
| 0% ≤ Si ≤ 3% |
| 0% ≤ Nb ≤ 0.5% |
| 0% ≤ B ≤ 0.05% |
| 0% ≤ C ≤ 0.1% |
| 0% ≤ Zr + Ta ≤ 0.5% |
| 0% ≤ Ni ≤ 5% |
| 0% ≤ Mn ≤ 2% |

the remainder consisting of iron and impurities resulting from elaboration, wherein:

either a structure of the continuously annealed strip is partially crystallized, and such that on at least 10% of a surface of samples observed under a microscope with a magnification of ×40 after chemical etching with iron perchloride, it is not possible to identify grain boundaries;

or a structure of the continuously annealed strip is crystallized, and such that on at least 90% of a surface area of a sample of said continuously annealed strip observed under a microscope with a magnification of ×40 after chemical etching with iron perchloride, it is possible to identify a network of grain boundaries and, among the grains having a surface area from 0 to 60 $\mu m^2$, there exists at least one first class of grain surface area with a class width of 10 $\mu m^2$ such that the first class of grain surface area of the continuously annealed strip comprises at least twice as many grains as the first class of grain surface area of a reference statically annealed cold rolled strip having the same composition as the continuously annealed strip and having a coercitive field such that a difference between the coercitive field of the reference statically annealed cold rolled strip and a coercitive field of the continuously annealed strip is less than half of the value of the coercitive field of the continuously annealed strip and, among the grains having a surface area from 0 to 60 $\mu m^2$, there exists at least one second class of grain surface area with a class width of 10 $\mu m^2$ for which a ratio of a number of grains in the second class of the continuously annealed strip to a total number of grains observed on the sample of the continuously annealed strip is greater by at least 50% than a ratio of a number of grains in the second class of the reference statically annealed cold rolled strip to a total number of grains observed on a sample of the reference statically annealed cold rolled strip, and wherein the continuously annealed strip has an elasticity limit $R_{p0.2}$ of at least 480 MPa.

2. The continuously annealed strip according to claim 1, wherein the chemical composition is such that:

| |
|---|
| 47% ≤ Co ≤ 49.5% |
| 0.5% ≤ V ≤ 2.5% |
| 0% ≤ Ta ≤ 0.5% |
| 0% ≤ Nb ≤ 0.5% |
| 0% ≤ Cr ≤ 0.1% |
| 0% ≤ Si ≤ 0.1% |
| 0% ≤ Ni ≤ 0.1% |
| 0% ≤ Mn ≤ 0.1% |

and in that the elasticity limit $R_{p0.2}$ is comprised between 590 MPa and 1,100 MPa, the coercitive field Hc is comprised between 120 A/m and 900 A/m, and the continuously annealed strip has a magnetic induction for a field of 1,590 A/m comprised between 1.5 and 1.9 Teslas.

3. The continuously annealed strip according to claim 1, wherein the continuously annealed strip has a magnetization at saturation greater than 2.25 T.

4. The continuously annealed strip according to claim 1, wherein, when the continuously annealed strip is subject to a bending test according to a procedure compliant with the ISO7799 standard, the continuously annealed strip is able to undergo at least 15 bendings.

5. The continuously annealed strip according to claim 1, wherein the continuously annealed strip has a thickness comprised between 0.05 and 0.6 mm, and in that the continuously annealed strip exhibits magnetic losses of less than 500W/kg at 400 Hertz under a field of 2 Teslas.

* * * * *